United States Patent [19]

Ginsburg et al.

[11] 4,398,307

[45] Aug. 16, 1983

[54] HINGE FOR TOILET SEAT

[75] Inventors: Milton Ginsburg, Bala Cynwyd, Pa.; C. Bruce Dawson, Winchester, Va.

[73] Assignee: Ginsey Industries, Inc., Bellmawr, N.J.

[21] Appl. No.: 385,545

[22] Filed: Jun. 7, 1982

[51] Int. Cl.[3] ..... A47K 13/12

[52] U.S. Cl. ..... 4/236; 4/240; 16/384; 16/388

[58] Field of Search ..... 4/234, 236, 237, 240; 16/382–384, 388

[56] References Cited

U.S. PATENT DOCUMENTS 3,046,570 7/1962 Young ..... 4/240

3,820,175 6/1974 Waldon ..... 4/236

*Primary Examiner*—Stephen Marcus

*Assistant Examiner*—Kenneth S. Putnam

*Attorney, Agent, or Firm*—Paul & Paul

[57] ABSTRACT

A composite hinge for a toilet seat comprises three leaves, namely, a bowl leaf, a seat leaf and a lid leaf. The three leaves are assembled into a unit by snap fitting the individual pieces together in interlocking manner. The assembled hinge is then adapted to be secured to the underside of the lid and to the underside of the seat ring by snap fitting the respective leaves into expandible holes in the seat ring and lid. The seat ring and lid are provided with studs with enlarged frusto-conical heads which are adapted to pass through the expandible holes which, after passage, contract to capture the studs.

16 Claims, 7 Drawing Figures

HINGE FOR TOILET SEAT

BACKGROUND OF THE INVENTION

The invention relates to toilet seats.

More particularly, the invention relates to a composite hinge having three arms or leaves, one each for attachment to the procelain bowl, to the ring seat, and to the lid.

In its preferred form, the invention is particularly applicable to cushioned toilet seats.

SUMMARY OF THE INVENTION

A principal object of the present invention is to provide a composite hinge, preferably of molded plastic component parts, having arms or leaves adapted to be attached to the porcelain bowl, to the toilet seat ring, and to the lid.

An important object of the present invention is to provide a composite hinge comprising three basic leaves which may be snap fitted together for quick and positive assembly.

A further object of the present invention is to provide a composite hinge of the foregoing type which, in addition to being snap fitted together for quick assembly, may be snap fitted into the toilet seat ring and into the lid.

DETAILED DESCRIPTION OF THE PREFERRED EMBODIMENTS

Figure 1:
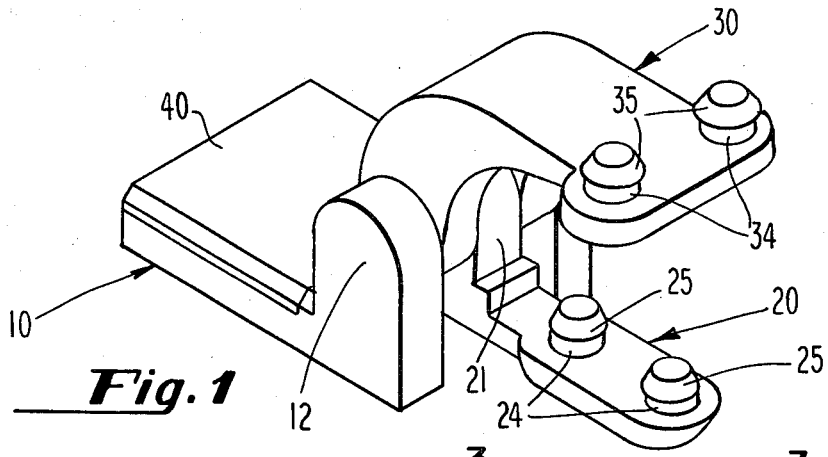
FIG. 1 is a perspective view of a composite hinge according to the present invention.
Figure 2:
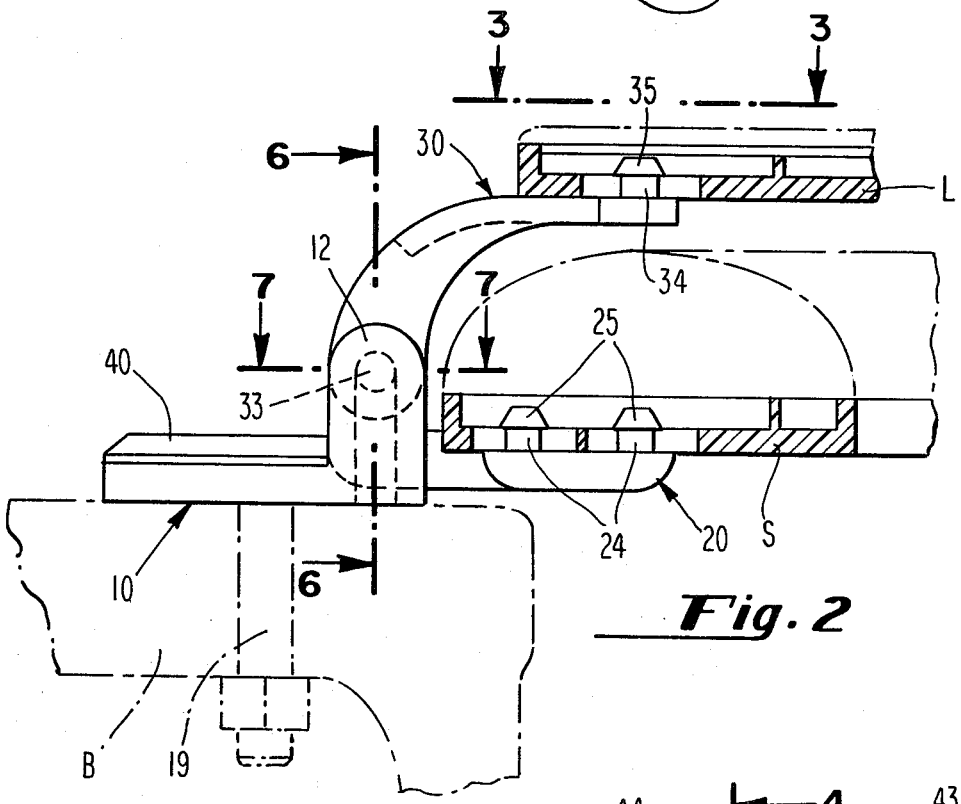
FIG. 2 is an elevational view, partially in section, showing the new composite hinge attached to the porcelain bowl.

Referring now to FIG. 1 there is shown, in perspective, a composite hinge according to the present invention. The hinge comprises a rear arm or leaf 10 adapted to be attached to the toilet bowl, a forwardly extending lower arm or leaf 20 adapted to be attached to the underside of the toilet seat ring at the rearward end thereof, and a forwardly extending upper arm or leaf 30 adapted to be attached to the underside of the lid at the rearward end thereof.

As seen in FIGS. 1,2,5 and 6, the forwardly extending seat leaf 20 has a vertical upright portion 21 at its rearward end. At an intermediate location in the upright portion 21 a pair of rectangular recesses 22 are provided, located opposite each other, as best seen in FIG. 7, defining therebetween a neck 23. Just rearward of neck 23, the rearward edge of the upright portion 21 is tapered or wedge shape, as at 26 in FIG. 7, thus forming a camming surface for assembly purposes, as will become clear.

Extending upwardly from seat leaf 20 at the forward portion thereof are a pair of studs 24 each of which has an enlarged head 25 of frusto-conical shape.

Figure 6:
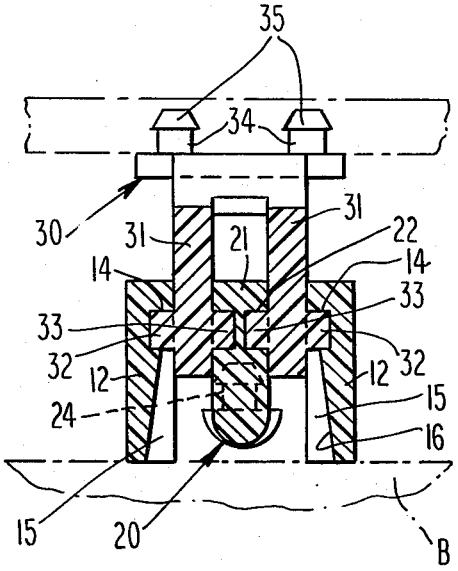
FIG. 6 is a view, in section, looking along the line 6—6 of FIG. 2.
Figure 7:
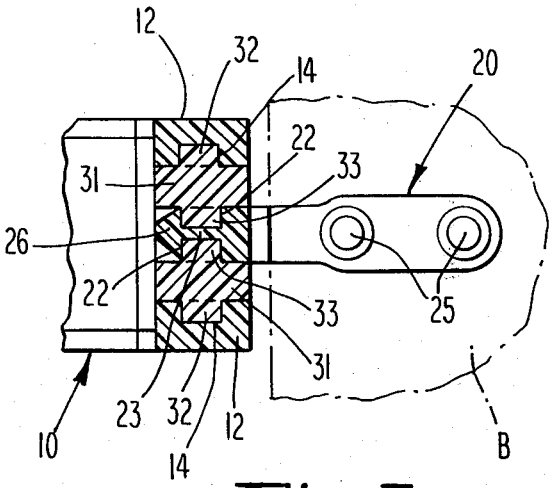
FIG. 7 is a view, in section, looking down along the line 7—7 of FIG. 2.

Referring now to the lid lead 30, this leaf has at its rearward end a pair of downwardly extending spaced-apart legs 31, best seen in FIG. 6. Each of the legs 31 is provided with two short integral pins 32 and 33 which extend laterally outwardly in opposing directions. The inwardly extending pins 33 of the two legs face each other, but are spaced apart by spacing having a width corresponding to that of the neck 23 of seat leaf 20.

Projecting upwardly from the upper surface of the forwardly extending portion of seat leaf 30 are a pair of studs 34 each of which has an enlarged head 35 of frusto-conical shape.

Bowl leaf 10 has at its forward end a pair of upwardly extending arms 12, best seen in FIG. 6. Each of the arms 12 is provided with a rectangular recess 14 for receiving the outwardly extending pins 32 of the lid leaf 30. Each of the arms 12 of bowl leaf 10 is also provided on its inward surface with an inclined groove 15, as seen in FIG. 6. The bottom of each groove 15 is inclined outwardly in the downward direction, forming the camming surfaces 16 for assembly purposes, as will become clear.

Figure 5:
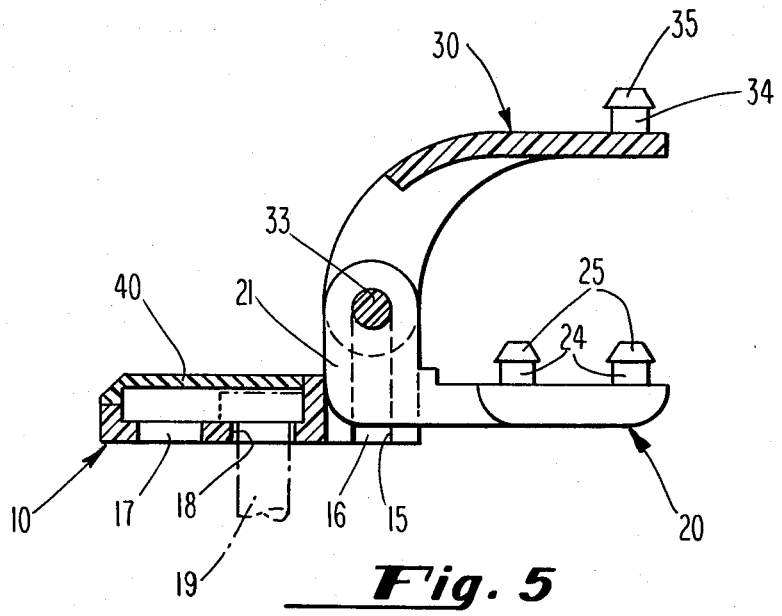
FIG. 5 is an elevational view, partly in section, of the composite hinge of the present invention.

As seen in FIG. 5, the horizontal portion of bowl leaf 10 is provided with a pair of bolt holes 17, 18, one of which is rearward of the other. In FIG. 5, the bolt 19 is shown in the forward bolt hole 18. In some toilet installations, the position of the water tank, relative to the location of the hinge pivot points of the toilet seat ring and lid, is such that when the lid and seat ring are raised, the ring is unable to pass through the vertical plane to an over-the-center position, and as a result, the ring does not remain in the raised position, but instead falls back down. This problem may be particularly troublesome in the case of a cushioned toilet seat. In such case, the rearward bolt hole 17 is used rather than the forward bolt hole 18. Use of the rearward bolt hole 17 moves forward the location of the hinge or pivot axis of the toilet seat ring and lid relative to the water tank, thereby enabling the raised seat ring to pass through the vertical plane to an over-the-center position, thereby enabling the ring and lid to remain in the raised position.

For appearance, and to facilitate cleaning, the bolt holes 17 and 18 are capped by a cap 40 which may preferably be press fitted into position.

The manner in which the composite hinge is assembled will now be described. The seat leaf 20 and the lid leaf 30 are assembled together first. This is done by placing the edge of the wedge 26 of seat leaf 20 in the spacing between the two pins 33 which extend inwardly from legs 31 of lid leaf 30. Compressive force is applied to force the wedge 26 through the space between the pins 33. This cams the legs 31 apart and allows the inwardly extending pins 33 to snap into the recesses 22 of seat leaf 20. This locks together the seat leaf 20 and the lid leaf 30. The bowl leaf 10 is then added to the assembly by placing the two legs 12 of the bowl leaf above the outwardly projecting pins 32 of legs 31 of lid leaf 30, with the pins aligned with the slots 15. When downward force is applied to the legs 12, the legs 12 are cammed apart, allowing the outwardly extending pivot pins 32 to move upwardly through the slots 15 and to snap into place in the recesses 14 of leg 12. This locks the bowl leaf 10 to the previously assembled seat leaf 20 and lid leaf 30. In the assembled condition, the lid leaf 30 is movable pivotally on the pins 32,33 thereby providing for raising and lowering of the lid L. The seat leaf 20 is pivotal on pins 33, thereby providing for raising and lowering of the seat ring.

It will be seen from the foregoing that the three leaf elements of the hinge assembly may readily be snap fitted together into interlocking engagement.

In accordance with a preferred embodiment of the present invention, the assembled seat leaf 20 and the lid leaf 30 are adapted to be snap fitted into the toilet seat ring and into the lid, respectively.

Figure 4:
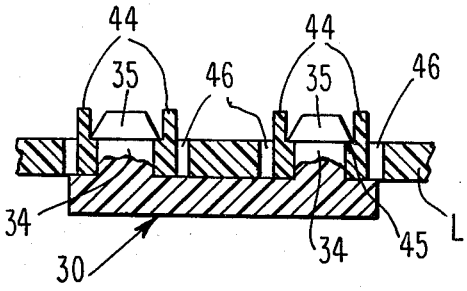
FIG. 4 is a view, in section, looking along the line 4—4 of FIG. 3.
Figure 3:
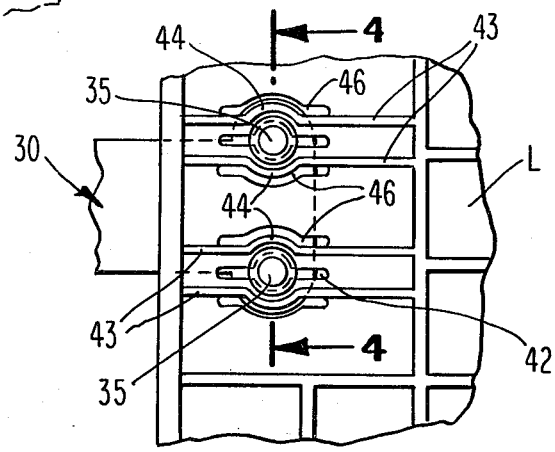
FIG. 3 is a view looking down along the line 3—3 of FIG. 2 showing the expandible holes in the lid into which the studs of the lid leaf are snap fitted.

FIGS. 3 and 4 illustrate how the lid leaf 30 is snapped into locked position on the underside of the lid L. Lid L is made of resilient plastic material. Formed in lid 40 are a pair of expandible through holes. Extending from each hole in opposing lateral directions are slots 42. Positioned on each side of the holes are ribs 43 having curved portions 44 which embrace a side portion of the hole. As best seen in FIG. 4, each embracing portion 44 has a shoulder 45 which is adapted to receive and support the annular shoulder formed by the large diameter portion of the frusto-conical heads 35 of the studs 34. Formed in lid L, just outside of the curved embracing portions 44 of ribs 43, are slots 46 having curved portions corresponding to those of the embracing portions 44 of the ribs 43.

It will be seen from an examination of FIGS. 3 and 4, and from the description given above, that when the studs 35 of lid leaf 30 are press fitted into the holes of the lid L, the material 44 of the ribs 43 on each side of each hole is cammed outwardly into the slot 46, thereby expanding the hole sufficiently to allow the enlarged head 35 of stud 34 to pass therethrough. As soon as the head of the stud has passed through the hole, the resilient rib material 44 returns to its original position, with the shoulder 45 moving under the annular shoulder head 35, thereby capturing the stud in the hole, and thereby securing the lid leaf to the lid.

Although not illustrated, the ring seat S is provided with similar expandible holes for receiving and capturing the studs 24 of the seat leaf 20.

What is claimed is:

1. A composite hinge for a toilet seat and lid adapted to be assembled by snap fitting together the elements of the hinge, said hinge comprising:

a. a bowl leaf;

b. a lid leaf;

c. a seat leaf;

d. said lid leaf having a forwardly extending portion and a pair of spaced-apart legs depending from said forwardly extending portion at the rearward end thereof, each of said legs of said lid leaf having a pair of integral pins extending laterally therefrom in opposing inward and outward directions, with the inwardly extending pins facing each other at spaced separation;

e. said seat leaf having a forwardly extending portion and an arm extending upwardly therefrom at the rearward end thereof, said upwardly extending portion being provided with opposed recesses for receiving the inwardly extending pins of said legs of said lid leaf, said opposed recesses defining a neck therebetween, the portion of said upwardly extending arm rearward of said neck having a camming edge for spreading apart the inwardly extending pins of said lid-leaf legs;

f. said bowl leaf having a base portion and a pair of spaced-apart arms extending upwardly from the forward portion of said base portion, the surfaces of said arms which face inwardly toward each other including camming surfaces, said legs above said camming surfaces being provided with recesses for receiving the outwardly extending pins of said lid-leaf legs.

2. A hinge according to claim 1 wherein the camming surfaces on the inwardly facing surfaces of the bowl leaf are provided by a vertical groove in each leg, the bottom surface of the groove inclining inwardly in the upward direction, said groove being adapted to receive the outwardly extending pins on the legs of the lid leaf, said pins in passing through said grooves camming said bowl-seat legs apart to allow said pins to be received and captured within said recesses.

3. A hinge according to claim 1 wherein said camming edge of said upwardly-extending arm of said seat leaf is wedge shaped.

4. A hinge according to claim 2 wherein said camming edge of said upwardly-extending arm of said seat leaf is wedged shaped.

5. A hinge according to claim 1 wherein projecting upwardly from said lid leaf is at least one stud having an enlarged frusto-conical head adapted to be press fitted into recesses in the toilet seat lid.

6. A hinge according to claim 3 wherein projecting upwardly from said lid leaf is at least one stud having an enlarged frusto-conical head adapted to be press fitted into recesses in the toilet seat lid.

7. A hinge according to claim 1 wherein projecting upwardly from said seat leaf is at least one stud having an enlarged frusto-conical head adapted to be press fitted into recesses in said toilet seat.

8. A hinge according to claim 3 wherein projecting upwardly from said seat leaf is at least one stud having an enlarged frusto-conical head adapted to be press fitted into recesses in said toilet seat.

9. A hinge according to claim 5 wherein projecting upwardly from said seat leaf is at least one stud having an enlarged frusto-conical head adapted to be press fitted into recesses in said toilet seat.

10. The hinge of claim 1 in combination with a toilet seat lid and a toilet seat ring, each of resilient plastic material, said seat and said ring each having therein at least one through hole adapted to be momentarily expanded to allow passage therethrough of a stud having an enlarged camming head.

11. The combination according to claim 10 wherein the material surrounding said hole is provided with a pair of slots, one on either side of said hole, at spaced separation therefrom forming between said slots and said hole a strip of material adapted to be cammed radially outwardly in response to the force applied to said material during the passage through said hole of said stud.

12. The combination according to claim 11 wherein said material on either side of said hole which forms said strip projects upwardly and is provided with shoulders for receiving and supporting the head of said cam headed stud.

13. The combination according to claim 10 wherein said material surrounding said hole is provided with slots which extend in opposite radial directions from said hole.

14. The combination according to claim 11 wherein said material surrounding said hole is provided with slots which extend in opposite radial directions from said hole.

15. The combination according to claim 12 wherein the head of said stud is frusto-conical.

16. The combination according to claim 14 wherein the head of said stud is frusto-conical.

* * * * *